United States Patent [19]

Kazumi et al.

[11] Patent Number: 4,834,818

[45] Date of Patent: May 30, 1989

[54] GAS-GENERATING COMPOSITION

[75] Inventors: Takashi Kazumi; Chitoshi Yano; Minoru Hayashi, all of Fukushima, Japan

[73] Assignee: Nippon Koki Co., Ltd., Tokyo, Japan

[21] Appl. No.: 157,884

[22] Filed: Feb. 19, 1988

[30] Foreign Application Priority Data

Mar. 10, 1987 [JP] Japan ..... 62-54840

[51] Int. Cl.[4] ..... C06B 35/00

[52] U.S. Cl. ..... 149/35; 149/17

[58] Field of Search ..... 149/35, 17

[56] References Cited

U.S. PATENT DOCUMENTS

| | | | |
|---|---|---|---|
| Re. 32,584 | 1/1988 | Pietz | 149/35 X |
| 2,156,942 | 5/1939 | Hatch | 149/35 X |
| 2,981,616 | 4/1961 | Boyer | 149/35 |
| 3,785,674 | 1/1974 | Poole et al. | 149/35 |
| 3,883,373 | 5/1975 | Sidebottom | 149/35 |
| 3,920,575 | 11/1975 | Shiski et al. | 149/35 |
| 3,947,300 | 3/1976 | Passaver et al. | 149/35 |
| 4,021,275 | 5/1977 | Kishi et al. | 149/35 |
| 4,376,002 | 3/1983 | Utracki | 149/35 |

*Primary Examiner*—John F. Terapane
*Assistant Examiner*—Susan Wolfe
*Attorney, Agent, or Firm*—Kalish & Gilster

[57] ABSTRACT

Provided herein is a gas-generating composition which forms combustion residues that can be easily captured. The gas-generating composition is composed of an azide of alkali metal or alkaline earth metal, oxidizer, and 0.1 to 10 wt % of one or two kinds of solder glass represented by BaO. $SiO_2$. PbO. Alkali or $B_2O_3$. $TiO_2$. $SiO_2$. $Na_2O$. The incorporation of solder glass reduces the weight of the filter to capture combustion residues by 5 to 30 wt %.

4 Claims, 1 Drawing Sheet

GAS-GENERATING COMPOSITION

BACKGROUND OF THE INVENTION

1. Field of the Invention:

The present invention relates to a gas-generating composition for the gas generator to supply a gas to the air bag, which is a safety fgeature that protects the driver and passengers in a car accident.

2. Description of the Prior Art:

There are several kinds of conventional gas-generating compositions composed mainly of an azide of alkali metal or alkaline earth metal and an oxidizer.

For example, there is described in U.S. Pat. No. 2,981,616 a gas-generating composition composed of an azide represented by $M(N_3)_x$, an oxidizer, and 0.1–3.0 wt % of combustion catalyst. M represents a hydrazino radical, ammonium radical, alkali metal, or alkaline earth metal, and the oxidizer is a metal peroxide, inorganic perchlorate, or metal nitrate.

In addition, U.S. Pat. No. 3,741,585 describes a combination of a metal azide and a metal sulfide or iodide; U.S. Pat. No. 3,895,098 describes a combination of an alkali metal azide and a metal oxide; and U.S. Pat. No. 3,931,040 describes a combination of an alkali metal azide, a metal oxide, and a metal carbonate Furthermore, Japanese Patent Publication No. 13735/1981 describes a formulation composed of a metal azide, an oxidizer, and a compound represented by $(Al_2O_3)_m(M\ O)_n(SiO_2)_p.qH_2O$ (where, M represents Li, Na, K, Sr, Mg, or Ca); and Japanese Patent Publication No. 20920/1983 describes a composition composed of a metal azide, an oxidizer, and silicon dioxide and/or boron oxide or metaphosphate.

The disadvantage of the conventional compositions is that many filters are required to remove metal ions and/or metal oxide formed by combustion, thereby to obtain a pure gas. This leads to large, heavy gas generators.

The present invention was completed to overcome the above-mentioned disadvantages involved in the prior arts.

SUMMARY OF THE INVENTION

Accordingly, it is an object of the invention to provide a gas-generating composition which forms combustion residues that can be easily captured.

The gist of the invention resides in a gas-generating composition composed mainly of an azide of alkali metal or alkaline earth metal, which comprises containing therein 0.1 to 10 wt % of one or two kinds of solder glass.

The solder glass is one which is represented by $BaO.SiO_2.PbO.Alkali$ or $B_2O_3.TiO_2.SiO_2.Na_2O$. They are commercially available from Toshiba Glass Co., Ltd. The object of the invention is not achieved by the other kinds of solder glass represented by $PbO.B_2O_3$, $P_2O_5.Al_2O_3$, $B_2O_3.ZnO$, $PbO.ZnO.B_2O_3$, $B_2O_3.ZnO.BaO$, $PbO.B_2O_3.TiO_2$, $B_2O_3.P_2$and $BaO.TiO_2.CaO.SiO_2$.

DETAILED DESCRIPTION OF THE INVENTION

The gas-generating composition composed mainly of an azide of alkali metal or alkaline earth metal forms, upon combustion, gaseous nitrogen and ions and oxides of alkali metal or alkaline earth metal. These ions and oxides have to be captured; but they can be captured only with difficulties because they are minute particles smaller than microns in diameter.

This problem is solved when the gas-generating composition is incorporated with solder glass. After the composition has burned, the solder glass remains unburned but readily absorbs the metal ions and/or metal oxides because it melts while the composition is burning. In addition, since the molten solder glass firmly sticks to a wire net used as a filter, it is possible to capture the molten solder glass together with the metal ions and/or metal oxides by means of the filter. The smaller the openings of the wire net, the more the amount of residues captured.

The nitrogen gas-generating composition usually contains an azide and an oxidizer (inorganic oxidizer and/or metal oxide) in an approximately stoichiometric ratio. Therefore, the gas-generating composition of the invention contains, for example, 60–90 wt % of azide of alkali metal or alkaline earth metal, 0–20 wt % of inorganic oxidizer, and 5 wt - stoichiometry of metal oxide.

To further illustrate the invention, the following examples are presented.

Example 1

Four samples in tablet form, 12.5 mm in diameter and 2 mm thick, were prepared by compression molding according to the formulations shown in Table 1. Solder glass having a composition of $BaO.SiO_2.PbO.Alkali$ was used. The samples were examined for burning performance. The results are shown in Table 1.

TABLE 1

| Component and Item | Composition (%) | | | |
|---|---|---|---|---|
| | No. 1 | No. 2 | No. 3 | No. 4 |
| $NaN_3$ | 74.9 | 74.9 | 74.9 | 74.9 |
| CuO | 9.1 | — | 9.1 | — |
| $Fe_2O_3$ | — | 9.1 | — | 9.1 |
| $KClO_4$ | 16.0 | 16.0 | 16.0 | 16.0 |
| Solder glass | 5.0 | 5.0 | — | — |
| Burning rate (mm/sec at 50 kgf/cm$^2$) | 51.5 | 39.2 | 73.0 | 46.0 |
| Pressure index | 0.11 | 0.23 | 0.28 | 0.30 |

Figure 1:
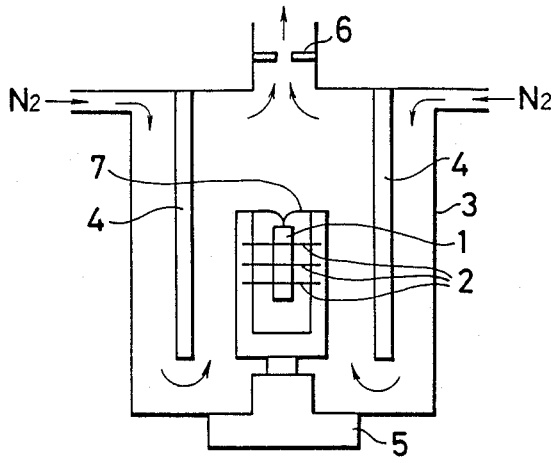
FIG. 1 is a schematic representation of the burning rate measuring apparatus used in the example of the invention.
Figure 2:
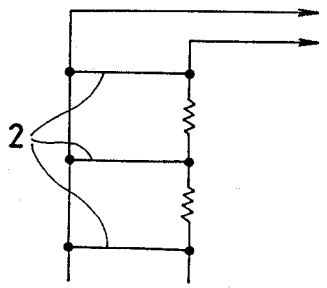
FIG. 2 is a partly enlarged view of FIG. 1.

The burning rate shown in Table 1 was measured with a Crawford-type burning rate measuring apparatus as shown in FIG. 1.

The measuring procedure is given below. A sample (gas-generating pellet) (1), 10–15 mm high, is attached to the sample holder (5) by means of fuses (2), and the sample holder (5) is set in the container (3). The container (3) permits nitrogen gas to pass through from the top downward and upward again along the partition wall (4), so that the burning rate and temperature of the sample (1) are kept constant. The pressure in the container (3) is controlled by the flow rate of nitrogen fed from a cylinder and the opening of the orifice (6) through which nitrogen is discharged into the atmosphere.

The sample (1) is ignited at its top by means of a nichrome wire (7) and igniter so that end-burning takes place downward. The time required for the sample to burn over a length between the two fuses (2) is measured, and the burning rate is calculated from the time. The measurement was carried out under varied pressures and the relationship between the burning rate and the pressure was investigated.

Since burning is a kind of chemical reaction, the burning rate (r) increases in proportion to the pressure (p). When the burning rate is plotted against the pressure on a logarithmic scale, an approximately straight line is obtained. Therefore, the relationship may be expressed by the equation $r=ap^n$ (where a is the coefficient of proportionality specific to individual gas-generating compositions, and the power n which determines the slope of the line is a constant called the pressure index of burning rate).

Because the burning rate varies depending on the pressure as mentioned above, the burning rate measured under 50 $kgf/cm^2$ is shown in Table 1.

It is noted from Table 1 that the pressure index of No. 1 is different from that of No. 2, where as the pressure index of No. 3 is almost identical with that of No. 4. This suggests that it is possible to control the pressure index if solder glass is added.

Example 2

Four compositions as shown in Table 2 were prepared. (The same solder glass as in Example 1 was used.) Each composition was made into a tablet, 12.5 mm in diameter and 2 mm thick. The amount of combustion residues was measured by using a small enclosed pump as explained later. The results are shown in Table 2.

TABLE 2

| | Experiment No. | | | |
|---|---|---|---|---|
| | 1 | 2 | 3 | 4 |
| Composition (%) | | | | |
| $NaN_3$ | 60.2 | 74.9 | 60.2 | 74.9 |
| CuO | 39.8 | 9.1 | 39.8 | 9.1 |
| $KClO_4$ | — | 16.1 | — | 16.0 |
| Solder glass | 5.0 | — | 5.0 | — |
| Ratio of residues captured (%) | | | | |
| Filter A | 54 | 49 | 51 | 40 |
| Filter B | 72 | 64 | 60 | 46 |

It is noted from Table 2 that the compositions Nos. 1 and 2 containing solder glass permit more combustion residues to be captured than the compositions No. 3 and 4.

Figure 3:
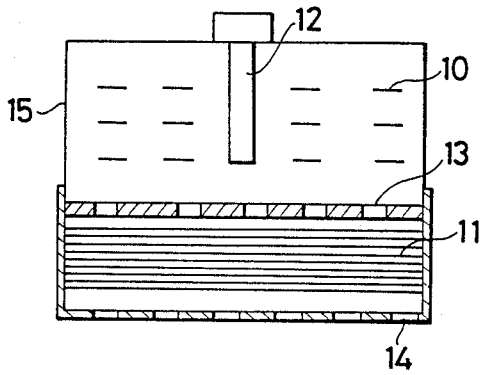
FIG. 3 is a schematic representation of the apparatus for measuring the ratio of residues captured which is used in the example of the invention.

The ratio of residues captured (in percent) given in Table 2 was calculated by dividing the amount of residues captured by the theoretical amount of residues. The combustion residues were captured by using an apparatus as shown in FIG. 3. The apparatus is made up of the chamber (15), the nozzle ring (13) having the same nozzle diameter as that of the gas-generator, the filter composed of stainless steel screens (11) placed on top of the other with packings interposed, and the nozzle plate (14). The screens (11) are arranged downward as follows:

Filter (A) Two 16-mesh screens, three 35-mesh screens, two 50-mesh screens, one 8-mesh screen (JIS standard screen)

Filter (B) Two 35-mesh screens, five 100-mesh screens, five 200-mesh screens, two 35-mesh screens.

The nozzle ring (13) and screens (11) are fixed in place by the nozzle (14) which is screwed to the chamber (15).

Example 3

Six compositions were prepared and experiments were carried out under the condition as in Example 2. The results are shown in Table 3.

TABLE 3

| | Experiment No. | | | | | |
|---|---|---|---|---|---|---|
| | 1 | 2 | 3 | 4 | 5 | 6 |
| Composition (%) | | | | | | |
| $NaN_3$ | 67.0 | 68.3 | 56.0 | 67.0 | 68.3 | 56.0 |
| $Fe_2O_3$ | 29.0 | 17.7 | — | 29.0 | 17.7 | — |
| $SiO_2$ | — | — | 26.0 | — | — | 26.0 |
| $KNO_3$ | — | 14.0 | 18.0 | — | 14.0 | 18.0 |
| $KClO_4$ | 4.0 | — | — | 4.0 | — | — |
| Solder glass | 5.0 | 5.0 | 5.0 | — | — | — |
| Ratio of residues captured (%) | | | | | | |
| Filter A | 51 | 65 | 83 | 41 | 57 | 74 |
| Filter B | 61 | 76 | 90 | 47 | 65 | 79 |

It is noted from Table 3 that the addition of solder glass permits more residues to be captured regardless of the metal oxides used. The effect of solder glass is enhanced where the filter of finer mesh is used.

Example 4

How the burning rate of the composition is affected by the amount of solder glass was investigated by using different compositions incorporated with solder glass ($BaO.SiO_2.PbO.Alkali$) in varied amounts (3%, 6%, and 9% based on the total weight of major components). The burning rate was measured under varied atmospheric pressures (10 atm, 30 atm, and 50 atm). The results are shown in Table 4.

TABLE 4

| Atmospheric pressure (atm) | Major components (%) | | | Amount of solder glass | | |
|---|---|---|---|---|---|---|
| | $NaN_3$ | $KClO_4$ | CuO | 3% | 6% | 9% |
| 10 | 74.9 | 5.2 | 19.9 | (26.3) | (24.6) | (22.0) |
| 30 | 74.9 | 5.2 | 19.9 | (33.8) | (27.0) | (26.6) |
| 50 | 74.9 | 5.2 | 19.9 | (—) | (—) | (46.4) |
| 10 | 74.9 | 10.2 | 14.9 | (32.0) | (31.9) | (31.1) |
| 30 | 74.9 | 10.2 | 14.9 | (40.7) | (39.2) | (37.3) |
| 50 | 74.9 | 10.2 | 14.9 | (46.8) | (44.3) | (42.5) |
| 10 | 74.9 | 15.2 | 9.9 | (36.4) | (37.6) | (35.5) |
| 30 | 74.9 | 15.2 | 9.9 | (46.3) | (45.9) | (44.4) |
| 50 | 74.9 | 15.2 | 9.9 | (53.6) | (51.0) | (50.0) |

Parenthesized numbers indicate the burning rate (mm/sec).

It is noted from Table 4 that the burning rate slightly decreases as the amount of solder glass increases; however, the decrease is not so great as to affect the performance so long as the amount is from 0.1% to 10%. In addition, the more the amount of solder glass increases, the higher the ratio of residues captured is expected to be. However, increasing the amount of solder glass decreases the amount of nitrogen gas generated per unit weight of the composition. Therefore, the upper limit of the solder glass should preferably be 10%.

As mentioned above, in the case of conventional nitrogen gas-generating compositons, the burning rate is determined by the components constituting the composition. However, in the case of the composition of the present invention, it is possible to freely control the burning rate and pressure index by changing the mixing ratio of the inorganic oxidizer and metal oxide. In the present invention, the burning rate under an atmospheric pressure of 50 kgf/cm$^2$ was compared because it varies depending on the atmospheric pressure.

The gas-generating composition is required to generate a gas at a varied rate according to the design of the air bag. The air bag as a safety feature of a car varies in size (volume) depending on the place (driver's seat or passenger's sheet) where it is installed. It also varies in the time expected for the bag to inflate according to the speed at which a collision occurs. The rate of gas generation is determined by the product of the burning rate under a given pressure and the burning surface area. In this connection, the gas-generating composition of the present invention is advantageous because it can be made to a desired burning rate and pressure index over a broad range.

The incorporation of solder glass into the gas-generating composition of the invention reduces the weight of the filter (stainless steel screens) by 5 to 30 wt %.

What is claimed is:

1. In a gas generating composition comprising from 60 to 90% by weight of an azide of an alkali metal or alkaline earth metal, up to 20% by weight of an inorganic oxidizing agent and from 5% by weight to a stoichiometrical amount of a metal oxide, the improvement characterized by said composition further comprising at least one solder glass selected from the group of compositions consisting of $BaO.SiO_2.PbO.Alkali$ and $B_2O_3.TiO_2.SiO_2.Na_2O$, in an amount of from 0.1 to 10% by weight.

2. A gas generating composition as claimed in claim 1, wherein the azide of an alkali metal or alkaline earth metal is sodium azide ($NaN_3$).

3. A gas generating composition as claimed in claim 1, wherein the inorganic oxidizing agent is potassium nitrate ($KNO_3$) or potassium perchlorate ($KClO_4$).

4. A gas generating composition as claimed in claim 1, wherein the metal oxide is iron oxide or copper oxide.

* * * * *